US005683475A

United States Patent [19]

Furukawa

[11] Patent Number: 5,683,475

[45] Date of Patent: Nov. 4, 1997

[54] METHOD FOR FABRICATING A BACKLIT ILLUMINATION DISPLAY FILM AND A TRANSLUCENT FILM FOR USE THEREFOR

[76] Inventor: Kenichi Furukawa, 1-11-13, Yukarigaoka, Sakura-shi, Chiba, 285, Japan

[21] Appl. No.: 632,234

[22] Filed: Apr. 15, 1996

[30] Foreign Application Priority Data

Apr. 27, 1995 [JP] Japan ..... 7-137100

[51] Int. Cl.[6] ..... D06P 5/00; G03C 8/10

[52] U.S. Cl. ..... 8/471; 8/506; 8/513; 430/201; 503/227

[58] Field of Search ..... 8/471, 506, 513; 430/201; 503/227

[56] References Cited

U.S. PATENT DOCUMENTS 4,965,240 10/1990 Imoto ..... 8/471
5,061,678 10/1991 Jongewaard et al. ..... 8/471
5,106,818 4/1992 Ashida ..... 8/471
5,364,412 11/1994 Furukawa ..... 8/471

*Primary Examiner*—Richard L. Schilling
*Attorney, Agent, or Firm*—Joseph C. Mason, Jr.; Louise A. Foutch

[57] ABSTRACT

Disclosed is a method for forming an imaged film for backlit illumination includes the steps of: providing a translucent film comprising a resin such as one selected from the group consisting of olefin resins, vinyl alcohol resins and fluorine-containing resins which resin has no affinity with a sublimating dye and a white pigment dispersed in the resin; contacting on the translucent film an original imagewise formed from a recording material containing the sublimating dye; and heating the original to allow the dye to be trapped in the film. Also, disclosed is a translucent film for use in preparing such an imaged film for backlit illumination. The use of the method and the translucent film allows fabrication of an imaged film for backlit illumination having a light resistant, high density image in cooperation with a computer-aided image editing system.

5 Claims, No Drawings

METHOD FOR FABRICATING A BACKLIT ILLUMINATION DISPLAY FILM AND A TRANSLUCENT FILM FOR USE THEREFOR

BACKGROUND OF THE INVENTION

1. Field of the Invention

This invention relates to a method for fabricating a backlit illumination display film and to a translucent film for use therefor. More particularly, this invention relates to a film which can form images in high density for use as a backlit illumination by thermal transfer of a recorded image made of a thermally sublimating dye and to a method for forming images for a backlit illumination on such a film.

2. Description of Related Art

Heretofore, imaged films used as sign boards for backlit illumination have been formed by silver halide photography in which a photographic photosensitive material is coated on a transparent or translucent film made of polyester or the like and the coated film is imagewise exposed to light and developed.

According to the above-described silver halide photography, imaged films having clear, high density images can be produced. However, this method has several problems. For example, it requires optical exposure so that when it is intended to produce enlarged photographs, a large space is necessary. Since it is of a so-called a wet type, the method calls for a well arranged environment. The method is not cooperative with a computer-aided image editing system. Images are vulnerable to deterioration due to ultraviolet rays in sunlight or backlight source. The fabrication of the films incurs high costs and takes a lot of time so that a longer target date or time to delivery is necessary.

In order to solve the above-described problems, there have been proposed various approaches. One of them is to utilize a electrostatic plotter or ink jet printer in order to form images on a translucent film with a pigment toner or an aqueous dye ink to give an imaged film for backlit illumination. The imaged film is advantageous in that it can be prepared efficiently by using a computer-aided system. However, when the imaged film is seen with a transmitting light, the feature of a backlit illumination system such that a clear (beautiful) image can be seen with backlit illumination is not fully utilized since the image on the film has an image density much lower than that of an image obtained by using a conventional silver halide photographic film. In the case where an electrostatic plotter is employed, the same image is outputted on two sheets of electrostatic recording paper and the image layers are peeled off from the recording paper with an adhesive sheet and the image layers are bonded to both surfaces of a double-coated adhesive sheet so that the images on the both surfaces match to each other (do not show discrepancy between them). Therefore, this approach involves complicated operations, which increases the manufacturing costs, and yet achieves insufficient density.

On the other hand, the use of an ink jet printer involves a problem that an expensive ink must be sprayed in an amount by 2 to 4 times as large as the amount usually used in order to obtain a high density image. This results in an extended printing time and, hence, an increase of cost. Furthermore, the resulting images have poor resistance to light or water. The formed images seem dull when viewed with reflected light, so that the backlight source must be turned on even in the daytime. In another approach, a monochromatic color film is cut into a desired pattern and put on a translucent film for backlit illumination so that the image can be viewed with a backlight. Also, this method suffers such problems that it is impossible to form an image having fine gradation and that the formation of an image involves complicated operations.

SUMMARY OF THE INVENTION

In the systems using an electrostatic plotter or an ink jet printer, failure to give high density images is ascribable to insufficient absorption of the light which corresponds to the images when the transmitted light from the backlight source passes through color ink since the layer of the color ink is thin. In order to increase the absorption of light so that the density can be increased, two important measures are to be taken. One is to thicken the colored layer itself and another is to substantially lengthen an optical path in which the transmitting light passes the colored layer.

Accordingly, the present inventors have investigated on the two points.

First, to thicken the colored layer, it is considered sufficient to perform coloring the lengths over all as uniformly as possible in accordance with images and the direction of the transmitting light passing through the thickness of the film.

The present inventors have confirmed that this object can be realized by providing a film made of a resin having no affinity with a sublimating dye and contacting the film an original image formed by a recording material containing the sublimating dye followed by heating so that the dye diffuse into the film to reach the back surface of the film to color the film.

Also, the present inventors have confirmed that the latter point, i.e., the longer optical path can be realized the use of a translucent film having dispersed therein a suitable amount of white pigment composed of fine particles of titanium oxide, silica or the like inorganic substance so that irregular reflection of light can occur repeatedly.

Therefore, this invention provides:

1) A method for preparing an imaged film for backlit illumination, comprising the steps of: providing a translucent film comprising a resin having no affinity with a sublimating dye and a white pigment dispersed in said resin; setting an original image formed from a recording material containing said sublimating dye in contact with said translucent film; and heating said original image to allow said dye to be trapped in said film.

2) The method as described in 1) above, in which the resin having no affinity with the sublimating dye is at least one resin selected from the group consisting of olefin resins, vinyl alcohol resins and fluorine-containing resins.

3) The method as described in 1) above, wherein a supporting surface made of a material selected from a group consisting of materials having no affinity with said dye and gas barrier materials impermeable to said dye is set in contact with a surface of said translucent film opposite to the surface in contact with said original image, prior to heating the original image to allow said dye to be trapped in said film.

4) A translucent film comprising a resin having no affinity with a sublimating dye and a white pigment dispersed in said resin for preparation of an imaged film for backlit illumination, wherein said translucent film is set in contact with an original image formed from a recording material containing the sublimating dye and the original image is heated to allow the dye to be trapped in said film.

5) The translucent film as described in 4) above, in which the resin having no affinity with the sublimating dye is at least one resin selected from the group consisting of olefin resins, vinyl alcohol resins and fluorine-containing resins.

DETAILED DESCRIPTION OF THE INVENTION

The sublimating dye which can be used in this invention is preferably a dye which sublimates or evaporates at a temperature of from 70° C. to 260° C. at atmospheric pressure. Examples of such a dye include azo dyes, anthraquinone dyes, quinophthalone dyes, styryl dyes, di- or triphenylmethane dyes, oxazine dyes, triazine dyes, xanthene dyes, methine dyes, azomethine dyes, cyclizine dyes, diazine dyes, and so on. In addition thereto, 1,4-dimethylaminoanthraquinone, 1,5-dihydroxy-4,8-diaminoanthraquinone bromide or chloride, 1,4-diamino-2,3-dichloroanthraquinone, 1-aminohydroxyanthraquinone, 1-aminohydroxyanthraquinone, 1-amino-4-hydroxy-2-(β-methoxyethoxy)anthraquinone, methyl, ethyl, propyl or butyl ester of 1,4-diaminoanthraquinone-2-carboxylate, 1-amino-4-anilidoanthraquinone, 1-amino-2-cyano-4-anilido (or cyclohexylamino)anthraquinone, 1-hydroxy-2-(p-acetaminophenylazo)-4-methylbenzene, 3-methyl-4-(nitrophenylazo)pyrazolone, 3-hydroxyquinophthalone, and so on. As the basic dye, there can be used Malachite Green, Methyl Violet, dyes modified with sodium acetate, sodium ethanolate, sodium methylate or the like.

The film-forming resins having no affinity with the sublimating dyes which can be used in the present invention include olefin resins such as polyethylene, polypropylene, polyvinyl chloride, etc., polyvinyl alcohols such as polyvinyl alcohol, polyethylene/vinyl alcohol copolymer, and fluorine-containing resins such as polyvinyl fluoride, polyvinylidene fluoride, polytetrafluoroethylene, tetrafluoroethylene/perfluoroalkyl vinyl ether copolymer, propylene copolymer, tetrafluoroethylene/hexafluoropropylene copolymer, tetrafluoroethylene/ethylene copolymer, polychlorotrifluoroethylene, and so on.

The white pigment which can be added to the film-forming resins includes inorganic white pigments such as titanium oxide, zinc oxide, silica, calcium carbonate, and the like.

The white pigments may have an average diameter in the range in which the average of pigments usually added to resins distributes. For example, the average diameter of the white pigments may be from 50 nm to 10 μm, preferably no greater than 1 μm.

The white pigment may be added to the film-forming resins in amounts such that the film-forming resins are translucent, i.e., visible light transmits at a transmittance of from 10 to 50%, preferably from 20 to 40%.

The white pigment may be blended and kneaded with the starting resin in a conventional manner and film-formation of the resulting resin may be performed by a conventional process.

In the present invention, a white pigment-blended translucent film of from 25 μm to 100 μm thick is used singly or as laminated with another film such as polyvinyl chloride for imparting a suitable strength or self-supporting property to the film. When it is of less than 25 μm thick, the film is difficult to handle since it tends to wrinkle or for some other reasons. A thickness of above 100 μm of the film is uneconomical.

An original image can be obtained from ink, coating composition, toner, or the like containing the sublimating dye by imaging using a conventional image recording technique, printing technique, coating technique, painting technique, or the like. It is preferred to use a color printer of a wet electrostatic recording type in which static charge images are formed directly with application of electric field onto an electrostatic recording medium, an ink jet printer or the like recording system which is of a computer-aided type and can output images without requiring formation of printing plates.

The original image printed by the above-described method is set in contact with a translucent film which has no affinity with the sublimating dye or a translucent polyvinyl fluoride film having dispersed therein titanium oxide or the like, and the original is heated, for example, at a temperature of from 140° C. to 180° C. so that the dye is dispersed into a depth of the film, for a short period of time, e.g., from 30 to 180 seconds. By this treatment, the dye which sublimated diffuses into a depth of the film so as to produce an image which corresponds exactly to the image of the original. The film on which the original is thermally transferred does not show a high density image when viewed with reflected light since the dye diffused in large amounts in the translucent film. However, when the film is viewed with transmitting light, a sufficiently high image density can be obtained. Use of sublimating dyes having excellent light resistance is advantageous since there can be obtained images having light resistance superior to silver halide photographic films.

Upon thermal transfer, a contact support is needed for a surface of the imaged film opposite to the surface in contact with the original image. If the support is made of a material which has affinity with the sublimating dye, such as polyester cloth or the like, a problem is that the dye which diffused in the film passes through the film and migrates into the support and trapped in the material constituting the support so that only a decreased amount of the dye is trapped in the target film. In order to prevent this, a measure may be taken to provide the film-contact-surface of the support with a material which is impermeable to the dye and is selected from materials having a high melting points and no affinity with the dye or materials having complete gas barrier properties. As such materials, there can be cited, for example, films or sheets of polytetrafluoroethylene, polydimethylsiloxane, silicone rubber, etc. and metal sheets such as stainless steel, etc. Also, there can be used for the purpose metal rolls or metal drums, rolls or drums lined with these dye-impermeable materials. Furthermore, a sheet of cellulose fiber, such as cotton cloth or paper, having no affinity with the above may also be used conveniently.

According to this invention, imaged films for backlight can be fabricated with ease at low costs in a very short period of time in cooperation with a computer-aided image editing system.

BEST MODE FOR CARRYING OUT THE INVENTION

Hereafter, this invention will be described in more detail by examples. However, this invention should not be construed as being limited thereto.

EXAMPLE 1

A transfer paper having an image printed thereon was prepared using color electrostatic plotter "JUANA" (trade name for a product by NIPPON STEEL CO., LTD.) which is capable of developing images on electrostatic recording paper with a liquid developer containing a sublimating dye. Between this transfer paper and a sheet of high quality paper was inserted a white translucent film, TEDLER TVW10AH8 (trade name for a product by DU PONT, 25 μm thick) and heated from the side of the transfer paper at 150° C. for 3 minutes under a pressure of 2 kg/cm to effect thermal transfer. As a result, there was obtained a film that had an image permeated to the back surface of the TEDLER film. When this film was set on a backlit illumination device and illuminated, it gave an image density as high as that obtained with a conventional silver halide film. Then, the film was measured of transmittance of visible light. The film was found to have a visible light transmittance of about 20 to 30%.

EXAMPLE 2

Thermal transfer was performed in the same manner as in Example 1 except that there was used a with translucent film (90 μm thick) made from a commercially available weatherproof, semi-hard polyvinyl chloride resin blended with a commercially available polymeric plasticizer. When the resulting film was set on a backlit illumination device and illuminated, it gave an image density as high as that obtained with a conventional silver halide film. Then, the film was measured of transmittance of visible light. The film was found to have a visible light transmittance of about 20 to 30%.

What is claimed is:

1. A method for preparing an imaged film for backlit illumination, comprising the steps of:

providing a translucent film comprising a resin having no affinity with a sublimating dye and a white pigment dispersed in said resin;

setting an original image formed from a recording material containing said sublimating dye in contact with said translucent film; and heating said original image to allow said dye to be trapped in said film.

2. The method as claimed in claim 1, wherein said resin having no affinity with said sublimating dye is an olefin resin.

3. The method as claimed in claim 1, wherein a supporting surface made of a material selected from a group consisting of materials having no affinity with said dye and gas barrier materials impermeable to said dye is set in contact with a surface of said translucent film opposite to the surface in contact with said original image, prior to heating the original image to allow said dye to be trapped in said film.

4. The method as claimed in claim 1, wherein said resin having no affinity with said sublimating dye is a vinyl alcohol resin.

5. The method as claimed in claim 1, wherein said resin having no affinity with said sublimating dye is a fluorine-containing resin.

* * * * *